US006132480A

United States Patent [19]

Barnes et al.

[11] Patent Number: 6,132,480

[45] Date of Patent: Oct. 17, 2000

[54] GAS FORMING IGNITER COMPOSITION FOR A GAS GENERANT

[75] Inventors: Michael W. Barnes, Brigham City; Kristy Woodward Swanson, Layton; Christopher Hock, Uintah, all of Utah

[73] Assignee: Autoliv ASP, Inc., Ogden, Utah

[21] Appl. No.: 09/299,153

[22] Filed: Apr. 22, 1999

[51] Int. Cl.[7] ..... C06B 43/00; C06B 33/08; C10L 1/30

[52] U.S. Cl. ..... 44/314; 44/324; 149/22; 149/38; 280/736; 280/741

[58] Field of Search ..... 149/22; 44/314

[56] References Cited

U.S. PATENT DOCUMENTS

| | | | |
|---|---|---|---|
| 4,865,667 | 9/1989 | Zeuner et al. | 149/22 |
| 5,109,772 | 5/1992 | Cunningham et al. | 102/275.11 |
| 5,401,340 | 3/1995 | Doll et al. | 149/22 |
| 5,429,691 | 7/1995 | Hinshaw et al. | 149/45 |
| 5,439,537 | 8/1995 | Hinshaw et al. | 149/22 |
| 5,592,812 | 1/1997 | Hinshaw et al. | 60/205 |
| 5,670,740 | 9/1997 | Barnes et al. | 149/62 |
| 5,673,935 | 10/1997 | Hinshaw et al. | 280/741 |
| 5,756,929 | 5/1998 | Lundstrom et al. | 149/22 |
| 5,866,842 | 2/1999 | Wilson et al. | 149/19.6 |
| 5,970,703 | 10/1999 | Hinshaw et al. | 60/219 |
| 5,985,060 | 11/1999 | Cabrera et al. | 149/62 |

FOREIGN PATENT DOCUMENTS

| | | |
|---|---|---|
| 196 16 627 A1 | 11/1997 | Germany . |

*Primary Examiner*—Ellen M. McAvoy
*Attorney, Agent, or Firm*—Sally J. Brown

[57] ABSTRACT

An igniter composition for a gas generant and related methods of gas generation are provided in which, in addition to a boron fuel component and an oxidizer component, the igniter composition additionally includes a gas-producing fuel component.

17 Claims, No Drawings

GAS FORMING IGNITER COMPOSITION FOR A GAS GENERANT

BACKGROUND OF THE INVENTION

This invention relates generally to the ignition of a gas generant such as used for the inflation of inflatable devices such as airbag cushions used in inflatable restraint systems for vehicle occupants. In particular, the invention relates to such an ignition material which, upon combustion, produces or results in a relatively large amount of gaseous products.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, the cushion begins to be inflated in a matter of no more than a few milliseconds with gas produced or supplied by a device commonly referred to as an "inflator."

Many types of inflator devices have been disclosed in the art for the inflating of one or more inflatable restraint system airbag cushions. Inflator devices which form or produce inflation gas via the combustion of a gas generating material, i.e., a "gas generant," are well known. It is also known that certain of such inflator devices may use such generated gas to supplement stored and pressurized gas by the addition of high temperature combustion products, including additional gas products, produced by the burning of the gas generating material to a supply of the stored, pressurized gas. In some cases, the combustion products produced by the burning of a gas generating material may be the sole or substantially the sole source for the inflation gas issuing forth from a particular inflator device.

It is common that inflator devices include an initiator, such as a squib, and an igniter. In practice, upon receipt of an appropriate triggering signal from a crash or other selected deceleration sensor, the initiator activates causing the rapid combustion of the igniter material, which, in turn, ignites the gas generant.

Commonly desired features or performance criteria for inflatable restraint system igniter compositions include:

1. ignitability via typical squib charges such as by means of primary explosives such as zirconium/potassium perchlorate or lead trinitroresorcinate, for example;
2. upon combustion, having a high heat of explosion;
3. ease and safety of manufacture and production;
4. exhibit minimal or reduced ignition delays, e.g., ignite a gas generant composition within an inflator device within about 10 milliseconds, preferably within about 8 milliseconds or less and, even more preferably, at least in certain applications, within about 5 milliseconds or less; and
5. produce or result in relatively low levels of various undesirable effluent gases such as nitric oxide (NO), ammonia ($NH_3$) and carbon monoxide (CO), for example.

Typical igniter compositions used in such applications are composed of a metallic fuel and selected oxidizer. Common useful metallic fuels for such compositions include boron, zirconium, titanium and silicon, for example. Typical or common oxidizers used in such compositions include alkali metal perchlorates, chlorates and nitrates. One such igniter formulation common or standard for use in airbag inflators is composed of about 15 to about 30 weight percent (typically about 25 weight percent) boron and about 70 to about 85 weight percent (typically about 75 weight percent) potassium nitrate. In the art, this standard igniter formulation is commonly referred to as "$BKNO_3$."

Unfortunately, typical igniter compositions, such as $BKNO_3$, are generally deficient in one or more of the above-identified criteria. Further, such typical igniter compositions may commonly burn at very high combustion temperatures, such as temperatures of up to about 3000 K. Also, the gas fraction produced by reaction of such igniter compositions is generally relatively low.

Thus, there is a need and a demand for an igniter composition and method of inflation gas generation which are generally more effective in satisfying one or more of the above-identified performance criteria. In particular, there is a need and a demand for an igniter composition and method of inflation gas generation which may more satisfactorily simultaneously fulfill multiple, and preferably each, of such performance criteria.

At the present time, sodium azide is a commonly accepted and used gas generating material. While the use of sodium azide and certain other azide-based gas generant materials meets current industry specifications, guidelines and standards, such use may involve or raise potential concerns such as involving handling, supply and disposal of such materials.

In addition, economic and design considerations have also resulted in a need and desire for alternatives to azide-based pyrotechnics and related gas generants. For example, interest in minimizing or at least reducing overall space requirements for inflatable restraint systems and particularly such requirements related to the inflator component of such systems has stimulated a quest for gas generant materials which provide relatively higher gas yields per unit volume as compared to typical or usual azide-based gas generants. Further, automotive and airbag industry competition has generally lead to a desire for gas generant compositions which satisfy one or more conditions such as being composed of or utilizing less costly ingredients or materials and being amenable to processing via more efficient or less costly gas generant processing techniques.

As a result, the development and use of other suitable gas generant materials have been pursued. In particular, efforts have been directed to the development of azide-free pyrotechnics for use in such inflator device applications. For example, U.S. Pat. Nos. 5,592,812 and 5,673,935, the disclosures of which are incorporated herein in their entirety, relate to certain metal complexes for use as gas generants. Such complexes are described as including a cationic metal template, sufficient oxidizing anion to balance the charge of the complex, and a neutral ligand containing hydrogen and nitrogen. In particular, disclosed are certain gas generant compositions which are at least essentially azide-free and which contain a metal ammine complex having a metal cation of a transition metal or an alkaline earth metal.

While these patents state that it is possible to initiate combustion reaction of these complexes by conventional igniter devices such as which include a quantity of $BKNO_3$ pellets, in practice it has been found sometimes difficult to ignite such gas generants using such conventional igniter compositions.

Thus, there is a need and a demand for igniter compositions which are effective for the igniting of various gas generant materials. In particular, there is a need and a demand for igniter compositions of improved effectiveness in the igniting of gas generants such as or similar to those described above.

SUMMARY OF THE INVENTION

A general object of the invention is to provide an improved igniter composition and method of generating gas suitable for use in the inflation of an airbag cushion of an inflatable restraint system of a motor vehicle.

A more specific objective of the invention is to overcome one or more of the problems described above.

The general object of the invention can be attained, at least in part, through including at least about 10 to about 25 composition weight percent of a gas-producing fuel component in an igniter composition containing a boron fuel component and an oxidizer component.

The prior art has generally failed to provide an igniter composition and method of gas generation which is as effective as desired in satisfying one or more of the above-identified performance criteria. Further, the prior art has generally failed to provide an igniter composition and associated method of gas generation relating to certain gas generants such as the above-identified metal complex gas generants which include a cationic metal template, sufficient oxidizing anion to balance the charge of the complex, and a neutral ligand containing hydrogen and nitrogen.

The invention further comprehends an igniter composition which contains:

about 10 to about 25 composition weight percent of boron fuel;

about 55 to about 80 composition weight percent of an oxidizer component; and about 10 to about 25 composition weight percent of an organic gas-producing fuel component.

The invention still further comprehends an improved method of generating gas suitable for use in the inflation of an airbag cushion of an inflatable restraint system of a motor vehicle wherein a gas generant composition is ignited with the reaction products of a boron fuel and oxidizer-containing igniter composition. In accordance with one embodiment of the invention, the improvement comprises the igniter composition containing at least about 10 to about 25 composition weight percent of an organic gas-producing fuel component.

As used herein, references to "ignition delay" are to be understood to refer to the period of time between when a particular system, e.g., an inflator, is first initiated and when that system first produces a measurable pressure output. As will be appreciated, it is generally desirable to control and, if possible, minimize such ignition delays in inflatable restraint systems. As identified above, it is generally desirable for inflatable restraint system ignition delays to be less than about 10 milliseconds, preferably about 8 milliseconds or less and, at least in certain applications within about 5 milliseconds or less.

Further, references herein to a material or component as a "gas producer" or the like are to be understood to refer to high yield gas producing material or components such as, when combusted with a standard oxidizer such as sodium nitrate, produces at least about 2.5 moles of gas per 100 grams of composition and preferably at least about 3.0 moles of gas per 100 grams of composition.

Other objects and advantages will be apparent to those skilled in the art from the following detailed description taken in conjunction with the appended claims.

DETAILED DESCRIPTION OF THE INVENTION

The present invention provides an igniter composition such as for a gas generant material used in the inflation of inflatable devices such as vehicle occupant restraint airbag cushions. Such combustible igniter compositions typically include a metallic fuel component, an oxidizer component and at least about 10 to about 25 composition weight percent of an energetic, gas-producing co-fuel component.

It has been unexpectedly found that the relatively high gas fraction producing igniter compositions of the invention can serve to more effectively ignite certain gas generant compositions, as compared to attempts to ignite such gas generant compositions using conventional, low gas fraction producing igniter compositions. For example, the igniter compositions of the invention have been found generally more effective in igniting gas generant compositions such as described in the above-identified U.S. Pat. Nos. 5,592,812 and 5,673,935. In particular, the igniter compositions of the invention have been found to be generally useful and effective in igniting such gas generant compositions which are identified as at least essentially azide-free and which gas generant compositions contain a metal ammine complex having a metal cation of a transition metal or an alkaline earth metal.

While the igniter compositions of the invention, in its broader terms, can generally be practiced with any effective combination of metallic fuel component, oxidizer component and gas-producing fuel component, the invention will be further described below with reference to certain preferred materials and material combinations.

In accordance with certain preferred embodiments of the invention, gas-producing fuel component materials used in the practice of the invention are preferably organic in nature. In particular, organic gas-producing fuel component materials useful in the practice of the invention can advantageously take the form of a nitrate of at least one amine or urea derivative. Examples of such materials include, but are not limited to, guanidine nitrate, ethylenediamine dinitrate, urea nitrate and semicarbazide nitrate.

In general, guanidine nitrate has been found to be a particularly desirable gas-producing fuel component for use in the practice of the invention. The desirability of the use of guanidine nitrate in the igniter compositions of the invention is generally based on a combination of factors such as relating to cost, stability (e.g., thermal stability), availability and compatibility (e.g., compatibility with other standard or useful igniter composition ingredients, for example).

While igniter compositions of the invention may advantageously contain such gas-producing fuel component in a relative amount in the range of about 10 to about 25 composition weight percent, certain preferred embodiments of the invention, particularly those wherein the gas-producing fuel component comprises guanidine nitrate, may include or contain such gas-producing fuel component in a relative amount in the range of about 15 to about 25 composition weight percent. Practice of the invention utilizing the inclusion of such a gas-producing fuel component within such range has been generally found to provide improved performance in terms of igniting various gas generant compositions. In particular, such improved performance may typically involve a favorable balance of either or both the realization of reduced ignition delays and production of undesirable trace gases such as nitrogen oxides (i.e., $NO_x$, where x=1 or 2, such as nitric oxide (NO) and nitrogen dioxide ($NO_2$)), ammonia ($NH_3$) and carbon monoxide (CO), for example, in reduced or otherwise acceptable amounts or levels.

While various metallic fuel materials, including boron, zirconium, titanium, magnesium, aluminum have in the past been used in igniter compositions in various metallic, combination or alloy forms, the practice of the invention employing boron metal has been found to generally result or provide the most desirable combination of stability (e.g., in terms of aging and thermal stability) and sensitivity (e.g., in terms of ease of ignitability).

While the invention can be practiced utilizing such fuel component is a wide range of relative amounts, in accordance with certain preferred embodiments, such fuel component, particularly such boron fuel component, may advantageously be present in the range of about 10 to about 25, preferably about 15 to about 20, composition weight percent. For example, operation within such ranges, particularly operation within such preferred range, can generally serve to again beneficially improve performance such as by either or both reducing ignition delays and production of undesirable trace gases.

Useful igniter composition oxidizers include alkali or alkaline earth metal nitrates, particularly preferred are the nitrates of sodium, potassium, and strontium with potassium nitrate being a particularly preferred oxidizer component for use in the practice of the invention. While the chlorates and perchlorates of alkali and alkaline earth metals, if desired, could be used, such chlorates and perchlorates generally exhibit too great a sensitivity to satisfy most practical inflatable restraint applications.

In practice, preferred igniter compositions for use in the practice of the invention contain such an oxidizer component in a relative amount of between about 55 to about 80 composition weight percent. One particularly preferred igniter composition contains about 55 to about 60 composition weight percent of potassium nitrate oxidizer component.

If desired, an igniter composition in accordance with the invention may also advantageously contain or include a relatively low level or amount of a non-energetic binder such as polyacrylamide, polyacrylic acid and combinations thereof. While the inclusion of such binder material can serve various functions, in certain preferred embodiments of the invention it may be desirable to include such binder material such as to facilitate subsequent processing, such as to facilitate subsequent granulation of the igniter composition such as to facilitate the formation of comparatively larger sized granules. In practice, the inclusion of such binder material in an amount of no more than about 3 to about 5 composition weight percent has been found to be generally effective for such uses.

The igniter compositions of the invention are advantageously and preferably ignitable by means of standard squib devices. Such squib devices typically include a bridgewire, an initiating explosive and a pyrotechnic output charge such as zirconium potassium perchlorate (commonly referred to as "ZPP"), for example. In practice, such pyrotechnic means of initiation commonly produce or form reaction products which in turn contact or otherwise initiate reaction of the igniter composition used in association therewith.

As will be appreciated, the compatibility of the subject igniter compositions with such standard squib devices facilitates the incorporation and use of such igniter compositions in various inflator or airbag systems without requiring special or possible costly design or processing modifications. As a result, various of the beneficial aspects of the igniter compositions of the invention and the uses thereof for gas generation such as relating to minimizing or reducing ignition delays, e.g., ignite a gas generant composition within an inflator device within about 10 milliseconds or less and producing or resulting in relatively low levels of various undesirable effluent gases such as nitrogen oxides ($NO_x$), ammonia ($NH_3$) and carbon monoxide (CO), for example, can more readily and practically be realized.

The igniter compositions of the subject invention are amenable to processing by various common or existing igniter composition processing techniques. For example and as described in greater below in connection with Example 1, the subject igniter compositions can be formulated and processed via simple dry blending, wet mixing, screening, drying, and milling.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

This example provides a step-by-step laboratory example of the preparation of an approximately 100 pound lot of an igniter composition in accordance with one embodiment of the invention:

Step 1—Dry blend 58.4 lbs. of $KNO_3$ with 24 lbs. of guanidine nitrate.

Step 2—Add 9.4 lbs. of water to the dry blend of Step 1 and blend the mixture for 5 minutes.

Step 3—To the wet blend of Step 2, add 17.6 lbs. of boron and 9.4 lbs. of ethanol and blend for 15 minutes.

Step 4—Hand screen the material blend of Step 3 through a 4-mesh screen onto conductive plastic-lined trays and into 2 lb. material increment units.

Step 5—Dry the material mix of Step 4 at 120° F. for at least 2 hours.

Step 6—The dried material of Step 5 was milled in two pound increments through a crackulizer mill, wherein the upper pair of grinding wheels are set with a 0.025 inch gap there between and the lower pair of grinding wheels are set with a 0.010 inch gap.

Step 7—The milled material of Step 6 was screened with a Sweco apparatus and the saving of milled material between 14 mesh and 200 mesh. This saved material totaled about 90 pounds.

Comparative Examples 1 and 2 and Example 2

In each of these runs, a 9 gram load of the respective igniter composition identified in TABLE 1, below, was loaded into a cylindrical igniter tube (i.e., diameter=0.4 inches and length=8 inches) containing a length of rapid deflagration cord (RDC) down the center of the tube.

In Comparative Example 1, the igniter composition was simply composed of 25 weight percent boron and 75 weight percent potassium nitrate. In Comparative Example 2, an igniter composition similar to that used in Comparative Example 1 but now additionally containing a minor amount of polyacrylamide binder (PAM) was used. In Example 2, the igniter composition of Example 1 was used.

The igniter composition-loaded igniter tube was then in each case placed in a cylindrical inflator test fixture (i.e., diameter=2.5 inches and length=12 inches) filled with about 100 grams of gas generant composed of hexammine cobalt (III) trinitrate, basic copper nitrate and a water soluble binder (guar gum).

In each run, the loaded test fixture was deployed into a 60 liter-closed tank. The pressure within the tank was measured as a function of time to permit the determination of the corresponding ignition delay. In addition, a sample of the effluent gas was analyzed by infrared spectroscopy to determine the composition thereof. The results are provided below in TABLE 1.

TABLE 1

| TRIAL | Comp. Ex. 1 | Comp. Ex. 2 | Example 2 |
|---|---|---|---|
| Igniter | $B/KNO_3$ | $B/KNO_3/PAM$ | $B/KNO_3/GuNO_3$ |
| Ignition Delay (ms) | 10–12 | 5–7 | 3–7 |
| CO (ppm) | 386 | 420 | 461 |
| NO (ppm) | 33 | 50 | 31 |
| $NO_2$ (ppm) | 5 | 13 | 2 |
| $NH_3$ (ppm) | 105 | 150 | 94 |

where:

PAM=polyacrylamide binder $GuNO_3$=guanidine nitrate

DISCUSSION OF RESULTS

As shown by the results in TABLE 1, the igniter composition of Comparative Example 1 resulted in an ignition delay of about 10–12 milliseconds. As identified above, ignition delays of such duration are generally unacceptable, at least for most inflatable restraint system applications.

TABLE 1 also shows that while the igniter composition of Comparative Example 2 resulted in a desirably reduced ignition delay of only about 5–7 milliseconds, the concentrations of various of the effluent trace gases were undesirably significantly increased. Thus, while the igniter composition of Comparative Example 2 generally resulted in an acceptable ignition delay, the concentrations of the various effluent trace gases may be unacceptable, at least for certain inflatable restraint system applications.

As shown by the results obtained in Example 2, the use of an igniter composition in accordance with the invention resulted in a favorable balance of reduced/acceptable ignition delay, i.e., an ignition delay of less than about 10 milliseconds and, in particular, of only 3–7 milliseconds, while not significantly detrimentally impacting undesirable effluent trace gas concentrations. In fact, the concentrations of the various nitrogen-containing effluent trace gases (e.g., $NO_x$ and $NH_3$) were significantly less in Example 2 than in either Comparative Examples 1 or 2.

In view of the above, it is to be appreciated that the invention provides an improved igniter composition and related methods of gas generation which desirably overcome one or more of the problems described above. More particularly, the invention provides such igniter compositions and corresponding or associated methods of gas generation which more easily permits or allows desired and satisfactory fulfillment of commonly desired features or performance criteria for inflatable restraint system igniter compositions such as:

1. ignitability via typical squib charges such as by means of primary explosives such as zirconium/potassium perchlorate or lead trinitroresorcinate, for example;
2. upon combustion, having a high heat of explosion;
3. ease and safety of manufacture and production;
4. exhibit minimal or reduced ignition delays, e.g., ignite a gas generant composition within an inflator device within about 10 milliseconds or less; and
5. produce or result in relatively low levels of various undesirable effluent gases such as nitrogen oxides ($NO_x$), ammonia ($NH_3$) and carbon monoxide (CO), for example.

In particular, igniter compositions in accordance with the invention have been found to produce a relatively small or reduced amount of generally undesirable effluent gases, such as nitrogen oxides, for example, while also advantageously resulting in reduced ignition delays such as compared to typical igniter compositions, such as $BKNO_3$.

It is to be understood that discussions of theory, such as including theories or explanations presented regarding the functioning or operation of various compositional components, for example, are included to assist in the understanding of the subject invention and are in no way limiting to the invention in its broad application.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In a method of generating gas suitable for use in the inflation of an airbag cushion of an inflatable restraint system of a motor vehicle wherein a gas generant composition is ignited with the reaction products of a boron fuel and oxidizer-containing igniter composition, the improvement wherein said igniter composition includes at least about 15 composition weight percent boron and additionally comprises at least about 15 composition weight percent of an organic gas-producing fuel component.

2. The method of claim 1 wherein the gas generant composition comprises a metal ammine complex having a metal cation of a transition metal or an alkaline earth metal.

3. The method of claim 1 wherein the organic gas-producing fuel component is a nitrate of at least one amine or urea derivative.

4. The method of claim 3 wherein the organic gas-producing fuel component is guanidine nitrate.

5. The method of claim 4 wherein the igniter composition comprises:

about 15 to about 20 composition weight percent of boron fuel;

about 55 to about 60 composition weight percent of potassium nitrate oxidizer component; and about 15 to about 25 composition weight percent of guanidine nitrate.

6. The method of claim 1 wherein gas is produced with an ignition delay of less than about 10 milliseconds.

7. The method of claim 1 additionally comprising the step of contacting the igniter composition with the reaction products of a pyrotechnic-containing squib.

8. The method of claim 1 wherein the igniter composition includes no more than about 25 composition weight percent of boron fuel.

9. The method of claim 1 wherein the organic gas-producing fuel component is guanidine nitrate and the igniter composition includes no more than about 25 composition weight percent guanidine nitrate.

10. A method of generating gas suitable for use in the inflation of an airbag cushion of an inflatable restraint system of a motor vehicle, said method comprising:

igniting an igniter composition containing an oxidizer component, at least about 15 composition weight percent of a boron fuel component, and at least about 15 composition weight percent of a guanidine nitrate gas-producing fuel component, to form igniter composition reaction products and contacting a gas generant composition with the igniter composition reaction products to form inflation gas.

11. The method of claim 10 wherein the gas generant composition comprises a metal ammine complex having a metal cation of a transition metal or an alkaline earth metal.

12. The method of claim 10 wherein the igniter composition includes no more than about 25 composition weight percent of the boron fuel component.

13. The method of claim 10 wherein the igniter composition includes no more than about 25 composition weight percent guanidine nitrate.

14. The method of claim 13 wherein the igniter composition includes no more than about 25 composition weight percent of the boron fuel component.

15. The method of claim 10 wherein the inflation gas is produced with an ignition delay of less than about 10 milliseconds.

16. The method of claim 10 wherein the step of igniting the igniter composition comprises firing a squib device.

17. A method of generating gas suitable for use in the inflation of an airbag cushion of an inflatable restraint system of a motor vehicle, said method comprising:

igniting an igniter composition containing an oxidizer component, at least about 15 composition weight percent of a boron fuel component and between about 15 to about 25 composition weight percent of a guanidine nitrate gas-producing fuel component, to form igniter composition reaction products and contacting a gas generant composition with the igniter composition reaction products to form inflation gas, the gas generant composition comprising a metal ammine complex having a metal cation of a transition metal or an alkaline earth metal.

* * * * *

UNITED STATES PATENT AND TRADEMARK OFFICE

CERTIFICATE OF CORRECTION

PATENT NO. : 6,132,480
DATED : October 17, 2000
INVENTOR(S) : Vivian M. Lutz

It is certified that error appears in the above-identified patent and that said Letters Patent is hereby corrected as shown below:

Column 1,
Line 25, "to Schbttes et al" should be --to Schlottes et al.--.

Column 5,
Line 10, Claim 1, --a stoma of -- should be inserted after "securing to" and before "a user".
Line 24, Claim 1,"mounted on the tube between the ends of the tube to allow attachment of the tube to clothing being worn by the user" should be
--mounted on the tube adjacent the second end of the tube to allow attachment of the second end of the tube to clothing being worn by the user adjacent the waist of the user wherein the attachment means--.
Line 36, Claim 5,"wherein the tube has a length such as to extend" should be -- wherein the tube is adapted to extend--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*